US010692482B2

(12) United States Patent
Zhu

(10) Patent No.: US 10,692,482 B2
(45) Date of Patent: Jun. 23, 2020

(54) IN-EAR ACTIVE NOISE REDUCTION EARPHONE

(71) Applicant: SHENZHEN CANNICE TECHNOLOGY CO., LTD., Shenzhen, Guangdong (CN)

(72) Inventor: Qilong Zhu, Guangdong (CN)

(73) Assignee: SHENZHEN CANNICE TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 16/231,423

(22) Filed: Dec. 22, 2018

(65) Prior Publication Data

US 2019/0371290 A1 Dec. 5, 2019

(30) Foreign Application Priority Data

May 30, 2018 (CN) ..... 2018 1 0541567

(51) Int. Cl.
*H04R 1/10* (2006.01)
*G10K 11/178* (2006.01)

(52) U.S. Cl.
CPC ..... *G10K 11/1781* (2018.01); *H04R 1/10* (2013.01); *G10K 2210/1081* (2013.01); *G10K 2210/3045* (2013.01)

(58) Field of Classification Search
CPC ..... G10K 11/1781; G10K 2210/3045; G10K 2210/1081; H04R 1/10
See application file for complete search history.

(56) References Cited

U.S. PATENT DOCUMENTS

2014/0211970 A1* 7/2014 Sibbald ..... H04R 1/1041 381/309
2018/0020281 A1* 1/2018 Wurtz ..... G10K 11/178

* cited by examiner

*Primary Examiner* — Brian Ensey
(74) *Attorney, Agent, or Firm* — Yue (Robert) Xu; Apex Attorneys at Law, LLP

(57) ABSTRACT

An in-ear active noise reduction earphone includes a housing, and the housing includes a rear chamber and a front chamber, and the housing is laterally provided with a sound generating unit separating the rear chamber from the front chamber; the rear chamber is located at a top of the housing, a feedforward microphone is installed inside the rear chamber, the front chamber is located at a bottom of the housing, and a feedback microphone is installed inside the front chamber; and the front chamber includes a first front chamber and a second front chamber, and the feedback microphone is installed inside the second front chamber.

11 Claims, 1 Drawing Sheet

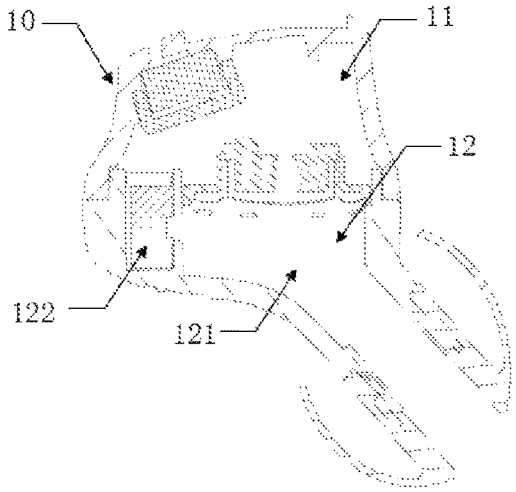
10
11
12
122
121
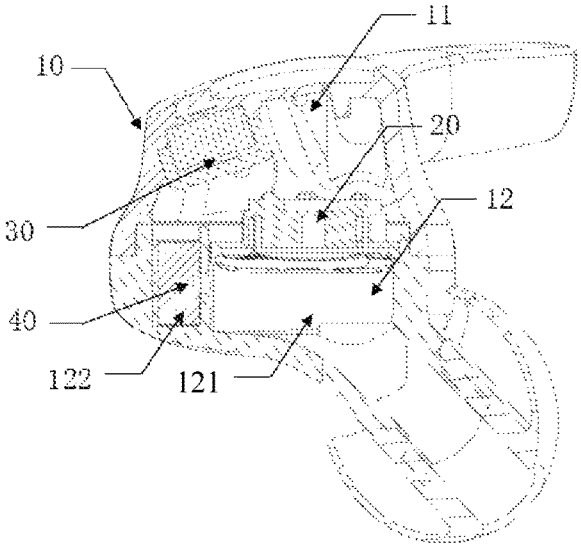
11
10
20
30
12
40
122
121

IN-EAR ACTIVE NOISE REDUCTION EARPHONE

CROSS-REFERENCE TO RELATED APPLICATIONS

This application claims the priority to Chinese Patent Application No. 201810541567.8, titled "IN-EAR ACTIVE NOISE REDUCTION EARPHONE", filed on May 30, 2018 with the National Intellectual Property Administration, PRC, which is incorporated herein by reference in its entirety.

FIELD

The present application relates to the technical field of earphones, and in particular to an in-ear active noise reduction earphone.

BACKGROUND

At present, with the development of society and the gradual improvement of people's living standards, earphones have become indispensable peripheral audio devices in modern electronic systems (such as mobile phones, tablets, and etc.). In-ear earphones stand out from many types of earphones because of the features of being easy to carry and having a fashionable appearance. The in-ear earphones are favored by more and more consumers, and are applied in more and more industries and fields, and the in-ear earphones have gradually become a trend in the earphone industry.

SUMMARY

An in-ear active noise reduction earphone is provided in embodiments of the present application, to improve the sound quality of the earphone.

In order to achieve the above object, the following technical solutions are provided according to the present application:

An in-ear active noise reduction earphone includes a housing, the housing includes a rear chamber and a front chamber, and the housing is laterally provided with a sound generating unit separating the rear chamber from the front chamber; the rear chamber is located at a top of the housing, a feedforward microphone is installed inside the rear chamber, the front chamber is located at a bottom of the housing, and a feedback microphone is installed inside the front chamber; and the front chamber includes a first front chamber and a second front chamber, and the feedback microphone is installed inside the second front chamber.

Furthermore, in the above-described in-ear active noise reduction earphone, the first front chamber is arranged below the sound generating unit; the second front chamber is arranged at one side of the first front chamber and between the rear chamber and the first front chamber, and separates the rear chamber from the front chamber together with the sound generating unit; and the second front chamber and the first front chamber are separated from each other by a diaphragm having a through hole at a middle of the diaphragm.

Furthermore, in the above-mentioned in-ear active noise reduction earphone, a sound output tube is formed in the first front chamber, and a bottom portion of the first front chamber is a sound output port for outputting sound; and a sound generating face of the sound generating unit faces downward toward the sound output port of the first front chamber, and the second front chamber is arranged at a side, away from the sound output port, of the first front chamber.

Furthermore, in the above-described in-ear active noise reduction earphone, the second front chamber includes a chamber body and a sealing cover for sealing the chamber body, and one side, close to the rear chamber, of the chamber body is sealed by the sealing cover, to be separated from the rear chamber.

Furthermore, in the above-described in-ear active noise reduction earphone, the second front chamber includes a chamber body and a sealant for sealing the chamber body, and one side, close to the rear chamber, of the chamber body is sealed by the sealant, to be separated from the rear chamber.

Furthermore, in the above-mentioned in-ear active noise reduction earphone, the feedback microphone is vertically arranged inside the second front chamber, to allow a sound receiving face of the feedback microphone to face left or right, and a center line direction of the feedback microphone, along the sound receiving face, is at an angle to a center line direction of the sound generating unit.

Furthermore, in the above-mentioned in-ear active noise reduction earphone, the angle is 90 degrees.

Furthermore, in the above-mentioned in-ear active noise reduction earphone, a diameter of the sound generating unit is smaller than or equal to 10 mm.

Furthermore, in the above-mentioned in-ear active noise reduction earphone, the sealant is an elastic sealant.

An in-ear active noise reduction earphone provided by the embodiments of the present application changes the angle between the feedback microphone and the sound generating unit by dividing the front chamber of the earphone into two parts, which not only plays a key role in improving the sound quality and reducing noise of the earphone, but also reduces the user's listening fatigue and improves the user experience. Meanwhile, the installation of the feedback microphone is more secure.

BRIEF DESCRIPTION OF THE DRAWINGS

In order to more clearly illustrate the technical solution in the embodiments of the present application or in the conventional art, the drawings referred to in the description of the embodiments or the conventional art will be briefly introduced hereinafter. Obviously, the drawings in the following description are only several embodiments of the present application. For those skilled in the art, other drawings can also be obtained according to these drawings without any creative work.

FIG. 1 is a side sectional view of an in-ear active noise reduction earphone according to an embodiment of the present application.

REFERENCE NUMERALS housing 10, sound generating unit 20,
feedforward microphone 30, feedback microphone 40,
rear chamber 11, front chamber 12,
first front chamber 121, second front chamber 122.

DETAILED DESCRIPTION OF THE EMBODIMENTS

For making the objects, features and advantages of the present application clearer and easier to be understood, the technical solutions according to the present application are described in detail hereinafter in conjunction with the drawings in the embodiments of the present application. Apparently, the embodiments described hereinafter are only a part of the embodiments of the present application, rather than all embodiments. Based on the embodiments of the present application, all of other embodiments, made by those skilled in the art without any creative efforts, fall into the scope of the present application.

In the description of the present application, it should be understood that, if a component is considered to be "connected" to another component, the former component may be directly connected to the another component or there may be an intermediate component therebetween. If a component is considered to be "arranged on" another component, the former component may be directly arranged on the another component or there may be an intermediate component therebetween.

In addition, it should be understood that the orientation or positional relationships indicated by terms "long", "short", "inner", "outer" and the like are based on the orientation or positional relationships shown in the drawings, and are merely for the convenience of describing the present application, and do not indicate or imply that the device or element referred to must be in a particular orientation, or be constructed and operated in a particular orientation, and therefore should not be construed as a limitation to the scope of the present application.

Technical solutions of the present application will be illustrated in detail through the embodiments and in conjunction with drawings.

First Embodiment

An in-ear active noise reduction earphone according to an embodiment of the present application changes an angle between a feedback microphone and a sound generating unit by dividing a front chamber of the earphone into two parts, which plays a key role in improving the sound quality and reducing the noise of the earphone, thereby reducing the user's listening fatigue and solving the problem of bad sound quality of the conventional in-ear earphones.

As shown in FIG. 1, the in-ear active noise reduction earphone includes a housing 10, wherein the housing 10 includes a rear chamber 11 and a front chamber 12, and the housing 10 is laterally provided with a sound generating unit 20 separating the rear chamber 11 from the front chamber 12. The rear chamber 11 is located at a top of the housing 10, a feedforward microphone 30 is arranged in the rear chamber 11, the front chamber 12 is located at a bottom of the housing 10, and a feedback microphone 40 is arranged in the front chamber 12. The front chamber 12 includes a first front chamber 121 and a second front chamber 122, and the feedback microphone 40 is arranged in the second front chamber 122.

The sound generating unit is a loudspeaker with a diameter smaller than or equal to 10 mm.

It should be noted that the housing 10 is an auxiliary support structure of the earphone, and the housing 10 further includes a partition wall structure for fixing the sound generating unit 20. the partition wall structure caves in a direction toward the sound generating unit 20 to form a mounting groove, and the sound generating unit 20 is embedded and fixed in the mounting groove.

As an example, the housing 10 and the partition wall structure may be made by stamping iron plate, die casting aluminum alloy or processing reinforced engineering plastics.

Preferably, a control circuit connected to the sound generating unit 20 is further mounted inside the housing 10. A noise audio signal collected by the feedforward microphone 30 is referred to as a first audio signal, a noise audio signal collected by the feedback microphone 40 is referred to as a second audio signal, the first audio signal and the second audio signal are respectively inputted into the control circuit, and the control circuit receives the first audio signal and the second audio signal and calculates waveform data of a noise sound wave formed by mixing the first audio signal and the second audio signal, and sends the data to the sound generating unit 20. The sound generating unit 20 generates a sound wave having the same amplitude as the noise sound wave and an opposite phase to the noise sound wave according to the data provided by the control circuit, to automatically cancel and process the noise. In this way, the sound emitted by the sound generating unit 20 can maximally avoid the interference of environmental noise, so that the user can listen in a relatively quiet environment, and clearly hear the sound with excellent sound quality.

Specifically, the rear chamber 11 is located at the top of the earphone housing 10, the feedforward microphone 30 is laterally mounted in the rear chamber, so that a sound receiving face of the feedforward microphone 30 faces up or down, and the feedforward microphone 30 is electrically connected to the control circuit through an audio signal transmission line. A clamp base or a clamp cover for mounting the feedforward microphone 30 is arranged in the rear chamber 11, a feedforward sound receiving opening in communication with the feedforward microphone 30 is arranged in the earphone housing 10 at a position above the feedforward microphone 30, and a rear chamber venthole in communication with the rear chamber 11 is arranged in the earphone housing 10 at a position corresponding to the rear chamber 11.

Preferably, the first front chamber 121 is arranged below the sound generating unit 20; the second front chamber 122 is arranged at one side of the first front chamber 121 and between the rear chamber 11 and the first front chamber 121, and separates the rear chamber 11 from the front chamber together with the sound generating unit 20; and the second front chamber 122 and the first front chamber 121 are separated by a diaphragm having a through hole at the middle.

Specifically, a sound output tube is formed in the first front chamber 121, and a bottom portion of the first front chamber 121 is a sound output port for outputting sound. A sound generating face of the sound generating unit 20 faces downward toward the sound output port of the first front chamber 121, and the second front chamber 122 is arranged on a side of the first front chamber 121 away from the sound output port.

The feedback microphone 40 is mounted in the through hole of the diaphragm and electrically connected to the control circuit through the audio signal transmission line.

Preferably, the earphone housing 10 is further provided with a front chamber venthole in communication with the front chamber 12, the front chamber venthole is in communication with the front chamber 12 through a vent passage, so that the feedback microphone 40 can receive noises from different directions introduced by the front chamber venthole. The front chamber venthole is located in the earphone housing 10 oriented in the same direction as the feedforward sound receiving port.

In one embodiment, preferably, the second front chamber 122 includes a chamber body and a sealing cover for sealing the chamber body, and one side of the chamber body close to the rear chamber 11 is sealed by the sealing cover, to be separated from the rear chamber 11.

The sealing cover is made from an elastic polymer material.

In another embodiment, preferably, the second front chamber 122 includes a chamber body and a sealant for sealing the chamber body, and one side of the chamber body close to the rear chamber 11 is sealed by the sealant, to be separated from the rear chamber 11.

Specifically, the second front chamber 122 is sealingly separated from the rear chamber 11 by injecting the sealant between the inner surfaces of the second front chamber 122 and the rear chamber 11 in a direction in which the second front chamber 122 directs toward the rear chamber 11.

The sealant is preferably embodied as an elastic sealant, such as rubber.

Preferably, the feedback microphone 40 is vertically arranged in the second front chamber 122, so that a sound receiving face of the feedback microphone 40 faces left or right, and the feedback microphone 40, along a center line direction of the sound receiving face, is at an angle to a center line direction of the sound generating unit 20.

Specifically, the feedback microphone 40 is vertically arranged in the through hole of the diaphragm of the second front chamber 122, so that the sound receiving face of the feedback microphone 40 faces left or right, and a center line direction of the feedback microphone 40, along the sound receiving face, is at an angle to a center line direction of the sound generating unit 20.

It can be understood that the angle can be designed as any angle as required by the practical production, for example, 75 degrees to 90 degrees. In this embodiment of the application, after strict tests, if the angle is set as 90 degrees, the effect is optimal.

An in-ear active noise reduction earphone provided by embodiments of the present application changes the included angle between the feedback microphone and the sound generating unit by dividing the front chamber of the earphone into two parts, which not only plays a key role in improving the sound quality and reducing noises of the earphone, but also reduces the user's listening fatigue and improves the user experience. Meanwhile, the installation of the feedback microphone is more secure.

In summary, the above embodiments are merely provided for illustrating the technical solutions of the present application, rather than limiting the application. Although the present application has been described in detail with reference to the above-described embodiments, those skilled in the art should understand that any modifications or equivalent substitutions to part of technical features can be made to the technical solutions described in the above embodiments, and these modifications and equivalent substitutions do not make the essence of the corresponding technical solutions depart from the spirit and scope of the technical solutions of embodiments of the present application.

What is claimed is:

1. An in-ear active noise reduction earphone, comprising a housing, wherein the housing comprises a rear chamber and a front chamber, and the housing is laterally provided with a sound generating unit separating the rear chamber from the front chamber;

the rear chamber is located at a top of the housing, a feedforward microphone is installed inside the rear chamber, the front chamber is located at a bottom of the housing, and a feedback microphone is installed inside the front chamber; and wherein, the front chamber comprises a first front chamber and a second front chamber, and the feedback microphone is installed inside the second front chamber; and wherein the first front chamber is arranged below the sound generating unit;

the second front chamber is arranged at one side of the first front chamber and between the rear chamber and the first front chamber, and separates the rear chamber from the front chamber together with the sound generating unit; and the second front chamber and the first front chamber are separated from each other by a diaphragm having a through hole at a middle of the diaphragm.

2. The in-ear active noise reduction earphone according claim 1, wherein a sound output tube is formed in the first front chamber, and a bottom portion of the first front chamber is a sound output port for outputting sound; and a sound generating face of the sound generating unit faces downward toward the sound output port of the first front chamber, and the second front chamber is arranged at a side, away from the sound output port, of the first front chamber.

3. The in-ear active noise reduction earphone according to claim 2, wherein the second front chamber comprises a chamber body and a sealing cover for sealing the chamber body, and one side, close to the rear chamber, of the chamber body is sealed by the sealing cover, to be separated from the rear chamber.

4. The in-ear active noise reduction earphone according to claim 2, wherein the second front chamber comprises a chamber body and a sealant for sealing the chamber body, and one side, close to the rear chamber, of the chamber body is sealed by the sealant, to be separated from the rear chamber.

5. The in-ear active noise reduction earphone according to claim 3, wherein the feedback microphone is vertically arranged inside the second front chamber, to allow a sound receiving face of the feedback microphone to face left or right, and a center line direction of the feedback microphone, along the sound receiving face, is at an angle to a center line direction of the sound generating unit.

6. The in-ear active noise reduction earphone according to claim 4, wherein the feedback microphone is vertically arranged inside the second front chamber, to allow a sound receiving face of the feedback microphone to face left or right, and a center line direction of the feedback microphone, along the sound receiving face, is at an angle to a center line direction of the sound generating unit.

7. The in-ear active noise reduction earphone according to claim 5, wherein the angle is 90 degrees.

8. The in-ear active noise reduction earphone according to claim 5, wherein a diameter of the sound generating unit is smaller than or equal to 10 mm.

9. The in-ear active noise reduction earphone according to claim 4, wherein the sealant is an elastic sealant.

10. The in-ear active noise reduction earphone according to claim 6, wherein the angle is 90 degrees.

11. The in-ear active noise reduction earphone according to claim 6, wherein a diameter of the sound generating unit is smaller than or equal to 10 mm.

* * * * *